US008479468B1

(12) United States Patent
Abbasi

(10) Patent No.: US 8,479,468 B1
(45) Date of Patent: Jul. 9, 2013

(54) STRUCTURE REHABILITATION AND ENHANCEMENT

(76) Inventor: Seyed Hossein Abbasi, Covina, CA (US)

( * ) Notice: Subject to any disclaimer, the term of this patent is extended or adjusted under 35 U.S.C. 154(b) by 1101 days.

(21) Appl. No.: 12/154,069

(22) Filed: May 20, 2008

Related U.S. Application Data

(60) Provisional application No. 60/931,288, filed on May 21, 2007.

(51) Int. Cl.
*E04B 5/43* (2006.01)
*E04B 5/02* (2006.01)
*E04B 7/22* (2006.01)

(52) U.S. Cl.
USPC ..... 52/408; 52/409; 52/412; 52/745.05; 52/745.19

(58) Field of Classification Search
USPC ..... 52/408–412, 309.16, 800.1, 799.1, 52/745.05, 745.19, 404.2; 428/418
See application file for complete search history.

(56) References Cited

U.S. PATENT DOCUMENTS 2,573,482 A * 10/1951 Peik ..... 52/443
3,350,827 A * 11/1967 Sugar ..... 52/309.3
3,466,222 A * 9/1969 Curtis ..... 428/142
3,740,910 A * 6/1973 Taylor et al. ..... 52/315
3,878,658 A * 4/1975 Davis et al. ..... 52/410
4,310,587 A * 1/1982 Beaupre ..... 442/31
4,357,377 A * 11/1982 Yamamoto ..... 428/40.3
4,425,746 A * 1/1984 Bonaguidi ..... 52/309.12
4,450,663 A * 5/1984 Watkins ..... 52/309.4
4,627,998 A 12/1986 Akihama et al.
4,841,705 A 6/1989 Fuhrer
5,114,653 A 5/1992 Schuerhoff et al.
5,212,927 A * 5/1993 Sheahan ..... 52/741.4
5,496,615 A * 3/1996 Bartlett et al. ..... 428/144
5,649,398 A 7/1997 Isley, Jr. et al.
5,657,595 A 8/1997 Fyfe et al.
5,711,834 A 1/1998 Saito
6,021,617 A * 2/2000 Sheahan ..... 52/410
6,164,031 A * 12/2000 Counihan ..... 52/480
6,806,212 B2 10/2004 Fyfe
7,096,631 B1 * 8/2006 Counihan ..... 52/403.1
7,200,973 B2 4/2007 Tunis
7,651,757 B2 * 1/2010 Jones et al. ..... 428/172
7,694,480 B2 * 4/2010 Niese et al. ..... 52/403.1
7,765,756 B2 * 8/2010 Bontrager, II ..... 52/410
2006/0191223 A1 * 8/2006 Bontrager, II ..... 52/411
2006/0230985 A1 10/2006 Derrigan et al.

FOREIGN PATENT DOCUMENTS

DE 4107594 C1 * 1/1992

* cited by examiner

*Primary Examiner* — Phi A
(74) *Attorney, Agent, or Firm* — Patent Law Agency, LLC; Peter Ganjian

(57) ABSTRACT

A system and a method for enhancement of structural integrity is provided where a reinforcement system in accordance with the present invention is coupled with a compression side of a structure. The reinforcement system includes a tension layer with a high tensile strength coupled with an exterior surface of a compression layer with high compression strength, with the tension layer directly coupled with the structure.

24 Claims, 4 Drawing Sheets

STRUCTURE REHABILITATION AND ENHANCEMENT

CROSS-REFERENCE TO RELATED APPLICATIONS

This Application claims the benefit of priority of U.S. Utility Provisional Patent Application No. 60/931,288, filed May 21, 2007, the entire disclosure of which Application is expressly incorporated by reference in its entirety herein.

BACKGROUND OF THE INVENTION

1. Field of the Invention

The present invention is related to structural rehabilitation and enhancement and, more particularly, to improving the structural capacity of structures by external reinforcements.

2. Description of Related Art

Construction materials, non-limiting examples of which may include wood, steel, concrete, etc. are routinely used in building structures. Most construction materials tend to deteriorate due to various reasons, including applied stresses, which weaken the built structure. Accordingly, it is sometimes necessary to reinforce an already constructed structure to improve or enhance its strength.

Some of the most common conventional methods for reinforcing already existing structural members are by mounting of reinforcements to the tension side thereof. Non-limiting examples of reinforcements may include the addition of steel plates or other supporting members such as additional columns or posts, beams, girders, or even additional walls, composite reinforcement materials, or any combination thereof to the tension side of the structural members for reinforcement.

As illustrated in prior art FIGS. 1A to 1D, under load conditions 106, a structure 102 must withstand horizontal forces 108 and 110, which are generally parallel along the neutral axis 112 of the structure 102. The horizontal forces may comprise of tensile forces 108 that tend to pull the structure 102, which produce elongation, and compression forces 110 that tend to push or compress the structure 102. Under heavy load conditions, the structure 102 must in addition withstand vertical forces 106 that are normal to the structure 102, which produce bending moments. Accordingly, as exemplarily illustrated in FIG. 1C, the exemplary tension zone for the exemplary structure 102 is at its underside 114, and the compression zone is located at its upper side 116. As more generally illustrated in FIG. 1D, the tension zones and the compression zones need not be limited to the underside 114 or the upper side 116 of a structure 102, but are found at any location where tensile forces 108 and the compression forces 110 exist, including, for example, tension zones 120 at the top of the supporting columns (negative load) 104.

In general, any element with a higher tensile strength (and relatively low compression strength) placed on top of a load-bearing element with lower tensile strength (and relatively high compression strength) will not provide adequate strength for the load-bearing element underneath (except in negative load zone). That is, for example, a deteriorating concrete slab (a load bearing element with low tensile strength, high compression strength) placed underneath a fiber reinforced polymer composite (with high tensile strength and low compression strength) will continue to deteriorate, crumble, and eventually buckle (in positive load zone). Therefore, it is most common to place reinforcing material with high tensile strength on the tension side of structures rather than on the compression side.

As an example, and as described and illustrated in the prior art U.S. Pat. No. 5,711,834 to Saito, the entire disclosure of which is expressly incorporated by reference in its entirety herein, the most common method for reinforcing structural members such as concrete slabs is the mounting of reinforcements to the underside of a slab, such as the underside of a bridge. However, as further described in Saito, this method was found to be unsuitable or impractical for reinforcement of heavily traveled topside surfaces such as the road surface of the bridge. To reinforce the topside, Saito places a unidirectional reinforcing fiber (high tensile strength) on top of thermosetting resin, which, in turn, is placed on top surface of a concrete slab (high compression strength). With this arrangement, the load-bearing element is the concrete slab with the unidirectional reinforcing fiber sheet placed on top of the concrete slab. The unidirectional reinforcing fiber is a low compression strength material and, therefore, cannot protect the underlying concrete, which has low tensile strength. The asphalt used on top of the fiber sheet is to protect the fiber form wear and tear and the outside environment, including heat, moisture, etc. Due to the nature of asphalt being a viscoelastic material, it is well known in the art that asphalt does not add much to the compression strength of structures because of its negligible and inconsistent compression and tensile strengths.

As a further example for the use of composites in reinforcing the tension-side of a structure, the U.S. Pat. No. 6,806,212 to Fyfe discloses that structures that must bear great weight, such as pillars, walls, or bridge spans, are often constructed from concrete and concrete is very strong under compression, so can support its own weight as well as the weight of other structural elements, people, vehicles, and equipment. Fyfe, the entire disclosure of which is expressly incorporated by reference in its entirety herein, further discloses that concrete is not strong under tension, though, and is a brittle material. Iron reinforcing rods are often embedded in concrete to increase the overall tensile strength. Nonetheless, to provide reinforcement, Fyfe discloses a coating method for strengthening the tension side of a concrete wall using composite material (tension side being the exploding side with the positive bending moment generated due to the direction of the exploding force).

As still another example for the use of composites in reinforcing the tension side of a structure, the U.S. Patent Application Publication 2006/0230985 to Derrigan et al. discloses that composite reinforcement materials have been used to strengthen existing concrete and masonry structures on the tension side. As further disclosed in Derrigan et al., while there are a number of advantages to using composite reinforcement materials, the composite reinforcement materials are generally much more combustible than concrete or masonry and, under the conditions of a fire, decrease the overall strength of the structure. To overcome this deficiency, Derrigan et al. insulates the fiber reinforced composite materials by a hydraulic cementitious material applied over the fiber reinforced polymer composite material, which does not add compression or tensile strength, but only provides added strength in terms of insulation for protection against heat or fire, comparable to gypsum or intumescent insulating materials, which have low compression and tensile strengths.

As is obvious from the prior art, conventional methods of reinforcements such as those taught by Saito, Fyfe, and Derrigan et al. base the determination factor for the location of the application of reinforcements onto a structure on the criteria of "heavy use" or tension zones, which is not practical or applicable to all structures. As is well known in the art for example, one of the tension zones of a roof structure is between two posts or columns that hold up the roof, with the tension zone being the underside of the roof (the ceiling) between the two posts or columns (similar to area 114 illustrated in FIG. 1C). However, as is common, a ceiling of a structure may include decorative features or other infrastructures such as piping, electrical, or other utilities, making the reinforcement on the tension side of the roof (the ceiling) impossible or at best, very costly. Further, in general, it is always more difficult in terms of access and cost to work against gravity (e.g., reinforcing a ceiling, which is the tension side of roof structure).

Accordingly, in light of the current state of the art and the drawbacks to current reinforcement methodologies mentioned above, a need exists for reinforcement of structures that would allow for strong reinforcement on the tension and or the compression sides of a load bearing structure so to avoid interference with any possible existing infrastructure (e.g., utilities) and, which would also provide both high compression and tensile strength, but without the addition of much bulk or weight.

BRIEF SUMMARY OF THE INVENTION

One exemplary aspect of the present invention provides a system and a method for enhancement of structural integrity by coupling a reinforcement system of the present invention with a compression side of a structure. The system and method of coupling of the reinforcement system is comprised of the operational acts of coupling a tension layer with a high tensile strength with an exterior surface of a compression layer with high compression strength, and coupling the tension layer directly with the structure.

An exemplary optional aspect of the present invention provides a system and a method for enhancement of structural integrity, wherein the coupling of the tension layer includes the operational act of reaching and preparing a surface of a substrate of the structure. Further included is the application of a first layer of polymer onto the substrate to prime the substrate, and place one or more layers of fiber reinforced polymer composite on top of the first layer, and insert anchors through all layers and into the structure substrate. Finally, apply a final layer of the polymer, which seals and encapsulates the top of the anchors and the fiber reinforced polymer composite underneath, and further provides mechanical bonding between the overlay and the final layer of the fiber reinforced polymer composite.

Another exemplary optional aspect of the present invention provides a system and a method for enhancement of structural integrity, wherein the coupling of the compression layer includes the operational act of applying an overlay onto the final layer.

Yet another exemplary optional aspect of the present invention provides a system and a method for enhancement of structural integrity, wherein the coupling of the compression layer further includes the operational act of applying a sealer onto the overlay for reducing potential porosity of the substrate, and for isolating the reinforcement system of the present invention from environment.

A further, exemplary optional aspect of the present invention provides a system and a method for enhancement of structural integrity, wherein the operational act of preparation of the surface structure to reach the structure substrate is comprised of removing existing surface finishes, including any surface material not part of the substrate to expose a surface of the substrate, and reducing the substrate surface defects to obtain a proper substrate surface profile.

Still a further, exemplary optional aspect of the present invention provides a system and a method for enhancement of structural integrity, wherein operational act of reducing the substrate surface defects includes patching substrate surface opening with material having physical characteristics at least equal to that of the substrate, and removing protuberances.

Another exemplary optional aspect of the present invention provides a system and a method for enhancement of structural integrity, wherein the polymer is a fluid precursor that cures under ambient conditions to form the polymer.

Yet another exemplary optional aspect of the present invention provides a system and a method for enhancement of structural integrity, wherein the fiber reinforced polymer composite is comprised of one of a field saturated fiber reinforced polymer composite, pre-cured fiber reinforced polymer composite, and pre-impregnated fiber reinforced polymer composite.

Still, another exemplary optional aspect of the present invention provides a system and a method for enhancement of structural integrity, wherein the fiber reinforced polymer composite is comprised of a pre-cured fiber reinforced polymer composite.

A further exemplary optional aspect of the present invention provides a system and a method for enhancement of structural integrity, wherein fibers of the fiber reinforced polymer composite are saturated by polymer and pre-cured.

Still, a further exemplary optional aspect of the present invention provides a system and a method for enhancement of structural integrity, wherein one or more layers of fiber reinforced polymer composites are amassed layer-by-layer with a layer of the polymer applied on top of each single layer of fiber reinforced polymer composite used.

Another exemplary optional aspect of the present invention provides a system and a method for enhancement of structural integrity, wherein fibers of material are saturated by polymer to form the fiber reinforced polymer composites.

Another exemplary optional aspect of the present invention provides a system and a method for enhancement of structural integrity, wherein fibers of material are field saturated to form fiber reinforced polymer composite using the operational acts of saturating the fibers with polymer to form the fiber reinforced polymer composite, and placing the fiber reinforced polymer composite onto the polymer.

Yet another exemplary optional aspect of the present invention provides a system and a method for enhancement of structural integrity, wherein fibers within the fiber reinforced polymer composite are comprised of strands that have suitable tensile strength and elongation properties.

A further exemplary optional aspect of the present invention provides a system and a method for enhancement of structural integrity, wherein the overlay is comprised of composite material with high compression strength.

Another exemplary optional aspect of the present invention provides a system and a method for enhancement of structural integrity, wherein the overlay is comprised of high compression composite material.

Another exemplary optional aspect of the present invention provides a system and a method for enhancement of structural integrity, wherein the overlay is comprised of high compression composite material reinforced with high tensile filers.

Another exemplary optional aspect of the present invention provides a system and a method for enhancement of structural integrity, wherein the overlay is comprised of high compression composite material reinforced with emulsified high tensile filers.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

Figure 1A:
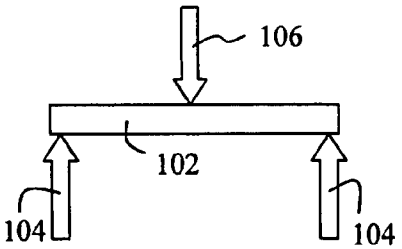
FIG. 1A (PRIOR ART)
FIGS. 1A to 1D are exemplary prior art illustrations, schematically illustrating the various forces on an exemplary structure.
Figure 1B:
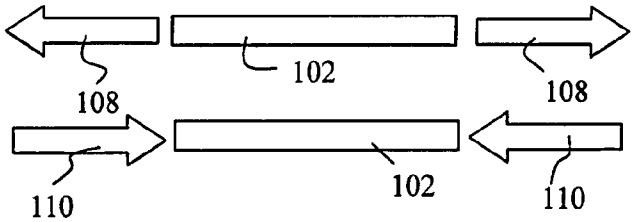
FIG. 1B (PRIOR ART)
Figure 1C:
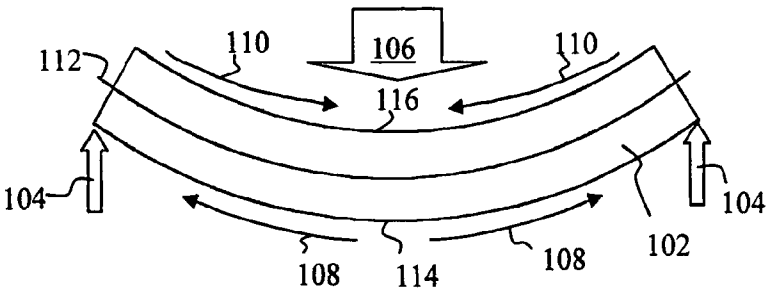
FIG. 1C (PRIOR ART)
Figure 1D:
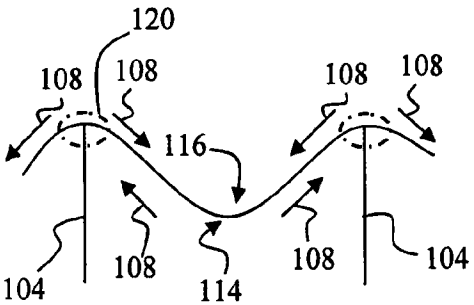
FIG. 1D (PRIOR ART)

The detailed description set forth below in connection with the appended drawings is intended as a description of presently preferred embodiments of the invention and is not intended to represent the only forms in which the present invention may be constructed and or utilized.

The present invention provides a method and a system for reinforcement of structures with a strong reinforcement that can be applied on the compression side of a load bearing structure. This way, the reinforcement will not interfere with any infrastructure (e.g., utilities, art works, etc.) that may exist on the tension side thereof. In particularly, the present invention can be applied continuously along the total length of repair/retrofit on the compression side with no discontinuity as compared with the prior art application of reinforcements to the tension side where discontinuities of the reinforcement may exist due to transition to column connections, girders, suspended utility, and or other hangers, etc. Further, the method and reinforcement system of the present invention does not work against gravity, making it easier and less costly to implement. That is, that application of the method and system of the present is not done against gravity (e.g., under an existing bridge deck or an existing slab in a building where utilities hang from the ceiling, including cable racks, air conditioning ducts, etc.

The present invention further provides a method and a system for reinforcement that has a very high compressive as well as a very high tensile strengths. In addition, the method and system of reinforcement in accordance with the present invention provides reinforcement that is not bulky and is lightweight compared with bulk and weight of prior art reinforcements with similar compressive and tensile strengths.

In particular, the method and system for structural rehabilitation and enchantment in accordance with the present invention provides an overall lightweight and compact size reinforcement system that is coupled with the compression side of a structure. The lightweight and compact size reinforcement system of the present invention has a thin, lightweight tension layer with a high tensile strength coupled with an exterior surface of a lightweight, compact size compression layer that has high compressive strength, with the tension layer directly coupled with the compression side of the structure. The compression layer is lightweight and less bulky relative to prior art materials (e.g., concrete reinforced with steel bars) that may have similar compressive and tensile strength. Accordingly, the present invention provides reinforcement with high compressive and tensile strengths, but without the addition of much bulk and weight. The reduction in bulk and weight of the reinforcement system of the present invention provides flexibility in terms of the use and application. In particular, the lightweight of the reinforcement system of the present invention enables its use in high-rise buildings, towers, etc. because it will not significantly shift the center of gravity of the building to a higher, less stable level, which is particularly important in geographic regions with high levels of seismic activities.

The present invention provides a method and system for enhancement of structural integrity, comprising coupling a reinforcement system with a compression side of a structure. The coupling of the reinforcement system of the present invention includes the operational acts of coupling a tension layer with a high tensile strength with an exterior surface of a compression layer with high compression strength, and coupling the tension layer directly with the compression side of the structure.

The present invention places a first reinforcement material layer with high tensile strength and low weight on a compression side of a substrate of a structure, and places a second reinforcement material layer with high compressive strength and low weight onto the first reinforcement material layer, with the total reinforcement being lightweight with small form factor.

The present invention provides a method and system for strengthening and enhancement of the structure based on a combination of anchored fiber reinforced polymer composites and a modified high compression overlay composite. The strengthening and enhancement provided by the method and system of the present invention include reinforcements that are lighter weight than prior art reinforcement systems such as steel, and or added concrete and or shotcrete, and at a fraction of space and time taken to implement and install the prior art systems. The present invention further provides for reinforcing structures such as concrete walls, concrete tilt up and pre-cast buildings and other vertical structural members from outside, especially in those areas where reinforcement from the inside is difficult or impossible.

The method and system for repair or enhancing load capacity of structures in accordance with the present invention includes in plane (within the plane of the surface structure) and out of plane retrofit/rehabilitation of structures. Non-limiting examples of structures may include concrete and masonry walls, cylindrical structures such as concrete reservoirs, silos, highway systems, etc.

Figure 2:
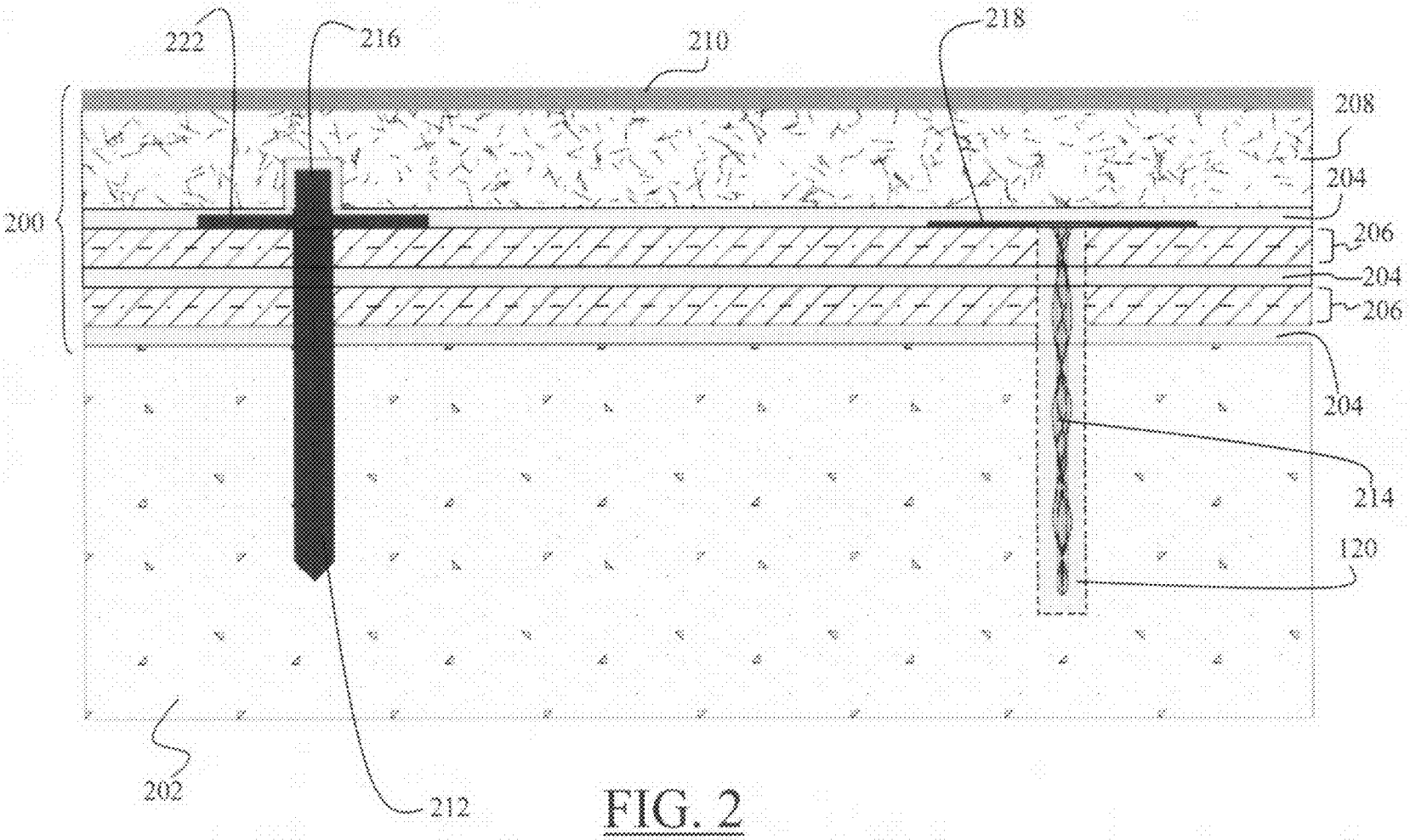
FIG. 2 is an exemplary illustration of a reinforcement system used for enhancement of structural integrity in accordance with the present invention.

FIG. 2 is an exemplary illustration of a reinforcement system 200 used for enhancement of structural integrity in accordance with the present invention. As illustrated in FIG. 2, reinforcement system 200 includes a first layer of polymer 204 applied onto a well-prepared surface of a substrate 202 of a structure, with a fiber reinforced polymer composite 206 bonded (via polymer 204) thereon. The entire reinforcement system 200 is further integrally bonded and secured by a set of anchors 212 and or 214 to the substrate 202 with an overlay composite 208. A well-known sealer 210 encapsulates the overlay 208.

The method of constructing the reinforcement system 200 includes preparing a receiving surface of the structure to reach structure substrate 202, and applying a first layer of polymer 204 onto the substrate 202 to prime the well-prepared substrate 202. Of course, all structural defects such as cracks must be repaired prior to preparation process of the surface, which can be done by appropriate well known means. The preparation of the structure surface to reach the structure substrate 202 is comprised of removing existing surface finishes, which may include the removal of any surface material not part of the substrate to expose the substrate 202. The preparation of the substrate 202 further includes reducing the substrate surface defects by obtaining proper substrate surface profile for the highest level of adhesion of the polymer to the substrate. Non-limiting example of such profile may include, for example, a profile of approximately ⅛ to about 1/16 of an inch.

The surface of the substrate 202 may be prepared by the following non-limiting, exemplary, non-exhaustive list of methods, including sandblasting, shotblasting, grinding, scarifying, acid etching, high pressure water blasting, or other methods to remove finishes and lose material and completely clean and obtain a sound structural surface with required profile free from foreign substances such as, for example, residues, oils, grease, coatings, sealers, and other contaminants. If necessary, oil contamination may be removed using a degreaser, and the surface should in general be afterwards thoroughly rinsed free of degreaser and other chemicals such as etching material. If required, further reducing the substrate surface defects may include patching the substrate surface openings with material having physical characteristics at least equal to that of the substrate 202, and may further include removing any protuberances thereon. Thereafter, the entire structural surface of the substrate 202 subject to repair is primed using the polymer 204, including the possible use of a filler material. The method and application of the polymer 204 and or a filler material are well-known and taught in Derrigan et al., the entire disclosure of which is expressly incorporated by reference in its entirety herein. In general, the polymer is a well-known off-the-shelf single or multiple component system that is combined and undergoes curing, which may be in the form of cross-linking under ambient conditions, to form the polymer 204. Of course, other means of curing are possible, which depend on the type of polymer used, non-limiting examples of which may including curing with moisture, oxygen, or other gasses, and/or radiations such as Ultra Violet (UV) radiations. A few, non-limiting examples of polymer 204 may include, for example, epoxy, acrylic, vinyl ester, polyester, furan, polyurethane, etc., or mixtures thereof. In general, the polymer 204 is a polymer binder resin. Any polymer resin having suitable viscosity to enable application to an underlying substrate and having reactivity characteristics such that it will not react with the underlying substrate, fiber reinforcement, or any possible insulating layer can act as a suitable polymer 204. The polymer or resin 204 should also have high tensile strength, low creep, and good adhesion properties.

After a thorough preparation of the substrate 202 and application of the polymer 204 as the first layer of reinforcement system 200 and prior to exposure to contaminants and while the polymer 204 is not fully cured and capable of fully bonding to a new top layer of polymer or polymer modified fiber composite, a fiber reinforced polymer composite 206 is applied onto the polymer 204. Fiber reinforced polymer composite 206 is comprised of single or multiple layers of material 230 that are made of fibers, which are saturated with the same type of polymer as the polymer 204. The material 230 is a well-known off-the-shell product that may exemplarily be in the form of a fabric made of arrangements of fibers, non-limiting examples of which may include, for example, fibers of aramid, carbon, metal, glass, nylon, natural fibers, etc., or combinations thereof. The fiber reinforced polymer composite 206 can be applied onto (or embedded within) the first layer polymer 204 in different orientations, including longitudinally along the axial length of the structure, transverse, and or at any angle (e.g., at a diagonal), or combinations thereof, depending on engineering and design concept and requirements. Further, the arrangement of the fibers of each individual fiber reinforced polymer composite layer 206 may also be at any orientation depending on engineering and design criteria to form a fabric. For example, the fibers may exemplarily be weaved to form the fabric, or laid as felt with multiple directions and may be weaved at any angle or orientations as required by the engineering and design.

In general, the fiber reinforced polymer composite 206 is applied onto the polymer 204 layer using a pre-cured, field saturated, pre-impregnated or any combination of any or all methods in accordance to design and manufacturer specifications. The preferred method of application is to use the pre-cured method, which is to saturate a layer of material 230 with polymer 204 and allow it to pre-cure off-site. The method of pre-curing is well known, and involves saturating the material 230 with polymer 204, and processing the saturated fibers of the material 230 through roller-presses to squeeze-in and force the polymer 204 onto all the fibers, and finally allowing the resulting saturated material 230 to cure under adequate pressure before the application of the resulting fiber reinforced polymer composite 206. If pre-cured fiber reinforced polymer composite 206 are used, the surfaces of the fiber reinforced polymer composite 206 must be roughened after saturation using sand broadcast method or if cured completely be wiped with proper solvent prior to application onto a still wet polymer 204 under appropriate pressure. As illustrated in FIG. 2, one or more layers of fiber reinforced polymer composite 206 may be amassed, layer-by-layer, with a layer of the polymer (primer) 204 applied on top of each single layer of fiber reinforced polymer composite 206 used.

If field saturated method is used to saturate the material 230, the fibers of the material 230 are saturated first (in the field) with polymer 204, after which the saturated material 230 (now the fiber reinforced polymer composite 206) are placed onto the wet layer of polymer 204. For vertical structures such as walls for example, the polymer may be semi-cured prior to the application of the fiber reinforced polymer composite 206. The material 230 is first saturated to form the fiber reinforced polymer composite 206, and applied while both the primed substrate and the fiber reinforced polymer composite 206 are still tacky and in semi-cured state. For horizontal application (e.g., roads) using the field saturated method, the polymer 204 can be wet at the time of installing the fiber reinforced polymer composite 206 while the fiber reinforced polymer composite 206 can be fully cured, semi-cured, or wet. In polymers, there is a time frame or workability period "pot life" from mixing of components to commencement of curing. However, during this pot life the polymer is not cured, and the pot life time varies depending on the type of polymer used, which in turn, depends on design and engineering requirements. Accordingly, for field saturation, the material 230 is saturated on site (forming the fiber reinforced polymer composite 206), brought, and placed onto the layer of freshly applied or the semi-cured polymer 204. It should be noted that when fiber felt is used as the material 230, the fiber felt is placed directly onto the polymer 204 (while the polymer 204 is still wet), and saturated further by introducing more polymer 204 by applied pressure (e.g., rollers or other methods) to form the fiber reinforced polymer composite 206 in place.

In general, field saturation of material 230 can be performed by a machine or manually. With the use of machines, the material 230 is saturated with polymer 204 and moved through machine rollers, where the polymer is roll pressed onto the fibers of the material 230, on the job site. With the manual method, the material 230 is placed onto a generally flat surface, and the polymer is literally worked into the fibers by any pressuring mechanism, including manually by hand rollers and or brushes. In general, the manual method is preferred for small patchwork, which is more economical, but in large applications the use of machines are preferred. Design specifications, shape of the substrate to be worked on, as well as jobsite conditions will dictate whether to use pre-cured or field saturated fiber reinforced polymer composite 206, and if field saturated fiber reinforced polymer composite 206 method is used, the shape and size of the substrate 202 will dictate whether to use manual or machine methodologies. It should be noted that a combination of pre-cured and field saturated fiber reinforced polymer composite 206 may be used on the same substrate. For example, substrates with shapes having flat sections may use the pre-cured fiber reinforced polymer composite 206, and irregular sections thereof may use a field saturated version.

After the required layers of fiber reinforced polymer composite 206 are installed, and within the allowed time window, anchors 212 and or 214 are then installed. Prior to insertion of anchors, the surface must be primed using the polymer 204 to wet the surface under the anchors. Anchors 212 and 214 are installed prior to completion of curing of the polymer 204. In general, any type of fasteners may be used that can function as anchors, non-limiting examples of which may include the used of threaded bolts, metal studs 212, fiber reinforced polymer composite anchors 214, etc., or any combination thereof.

Metal studs 212 include a protruded section 216 on top of the studs 212 that is extended, and covered by the overlay 208. Top sections 216 of the anchors are extended into the overlay 208 to make the overall system more integral, and enhance the reinforcement. Metal anchors 212 also include a lateral extension 222, which functions as a washer that further strengthen the metal stud grip onto the various layers of the reinforcement system 200. It should be noted that if the fibers of the fiber reinforced polymer composite laminate 206 are comprised of carbon, then a freshly saturated fiber reinforced polymer composite 206 comprised of glass fiber is placed in between a final layer of the carbon based fiber reinforced polymer composite 206 and an underneath extension 222 of the metal studs contacting the final layer. This way, the fiber reinforced polymer composite 206 comprised of glass fiber will insulate the final layer of 206 (comprised of carbon fibers) from that of the extension 222 of the metal stud to prevent chemical interaction between the carbon and the metal. Of course, given the costs, the fiber reinforced polymer composite 206 comprised of glass fiber is used as a patch with a size commensurate with the size of the underneath section 222 of the metal stud 212.

The fiber reinforced polymer composite anchors 214 may be comprised of the same fiber and polymer matrix as the fiber reinforced polymer composite 206. In addition, it should be noted that as with the fiber reinforced polymer composite 206, the fiber reinforced polymer composite anchors 214 may be pre-cured prior to application and use. The anchors 214 are placed within a hole 220 that is pierced through the various layers of the reinforcement system 200 prior to application of the overlay 208. At first, the fibers of the fiber reinforced polymer composite anchors 214 are placed within the hole 220 with a portion 218 of the fibers extended outside the hole 220. The hole 220 must be clean and free from dust or any foreign objects and filled with polymer 204, saturating the fiber therein prior to insertion of the anchor 214. The extended portion 218 is laid across the surface of a final layer of the fiber reinforced polymer composite 206, and then the hole 220 is filled with polymer 204, saturating the fiber therein to form a fiber reinforced polymer composite anchors 214.

Regardless of the fasteners used for anchoring, anchors 212 and or 214 are inserted through all layers and into the substrate 202 of the structure. Thereafter, a final layer of the polymer 204 is applied thereon to the preceding layer of the fiber reinforced polymer composite 206 and on top of the anchors 212 and or 214. As further illustrated, the top sections of the anchors 212 and or 214 can be extended into the overlay 208 to make the overall system integral, and to enhance the reinforcement. Accordingly, anchors are installed onto the existing substrate or may be extended into new overlay as needed, through the various layers of the reinforcement system 200 to integrally bond the layers thereof and incorporate the reinforcement system 200 into the repair system to fully support the structure as an integral part thereof.

After the last layer of polymer 204 is placed and prior to the polymer 204 being cured or while it is still wet, a layer of overlay 208 is placed over the system 200. The overlay is comprised of high compression composite material reinforced with high tensile fibers (or optionally, emulsified high tensile fibers). The overlay 208 is designed and manufactured to perform under high compression and relatively high tensile forces, non-limiting examples of which may include high performance concrete, an epoxy grout, or a modified cementicious grout. A non-limiting example of a high performance concrete is a mixture of magnesium phosphate cement, water, and fly ash that make up a high performance and light weight system. A non-limiting example of epoxy mortar/grout is a high compressive high tensile structural epoxy binder mixed with silicon or other high compression aggregates. A non-limiting example of modified cementicious grout is a polymer modified two-component mortar. Non-limiting examples of polymer component of the overlay 208 may include latex, epoxy, urethane, etc. The overlay 208 may be modified in accordance with the present invention by the addition of randomly oriented reinforcing fiber additives or reinforcing strands of fiber or reinforcing mesh to improve its tensile strength, which complements its already high compressive strength. Non-limiting examples of the randomly oriented reinforcing fiber additives may include, for example, polymer, emulsified glass, polyethylene, aluminum, stainless steel fibers, other metals, natural fiber, synthetic or composite mesh, etc. or combinations thereof. The overlay layer 208 can be a field manufactured by mixing and pouring as an overlay or it can be prefabricated off site and placed over the system 200 with a layer of polymer 204 as bonding material.

The overlay 208 can be applied by any well-known methods, non-limiting examples of which may include the use of a trowel, or by using hopper, air-less, or air-assisted texture equipment. After the overlay 208 is cured and ready, a sealer 210 is applied in one or more applications per design and manufacturer specifications. The purpose of the sealer 210 is to protect the overlay 208 from water, oil, fuel, and other common contaminants. In general, any sealer 210 that can reduce the porosity of the overlay 208, isolating the various layers of the reinforcement system 200 from ambient conditions, may be used. In fact, any type of sealer 210 commensurate with application and use may be utilized, non-limiting example of which may include those that merely insulate against fire rather than porosity.

Example

The following examples are set forth to further illustrate the reinforcement system of the present invention, and method and system for reinforcing a structural member. The following examples are merely illustrative and should not be construed as limiting in any manner.

Tests

The flexural-strength tests were conducted on conditioned specimens I and II (detailed below) maintained for 72 hours at an ambient temperature of 72±51° F. and a 50±5 percent relative humidity. Two specimens examined and measured to be 24"×24". All tests implemented a three point bending protocol where the rectangular flat tile specimen was simply supported on two opposite sides and free on the adjoining ends. Supports were selected to be parallel with the load and perpendicular to internal reinforcement of the tile. Specimens were positioned on the supports so that a one-inch buffer, associated with the tile, rested on the support away from the support's internal edge. In this manner, the specimens had a span of 22". A quarter-inch rubber gasket was placed between the specimen and the supports to insure even load distribution and limit areas of stress concentration. Load was applied at the mid-span with a self-aligning fixture that consisted of a cylindrical rod that was connected to the servo-hydraulic actuator. Test specimens were loaded at the rate of 2 kips per minute until specimen failure. Load and deflection data were captured continuously. Load was released when the actuator measured a sudden thirty percent drop in load.

Results

Results for I

Control Specimen

Figure 3:
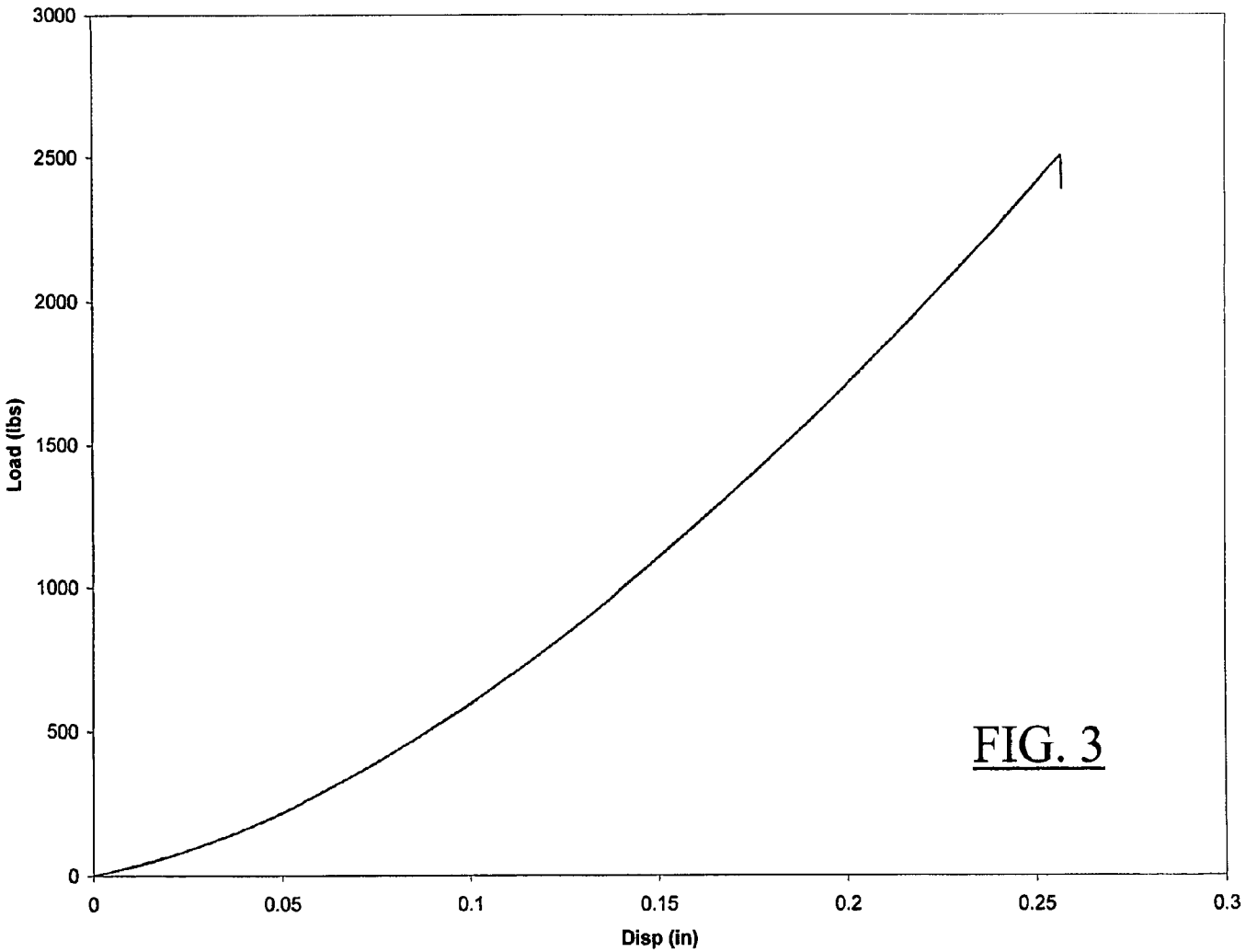
FIG. 3 is an exemplary graph, illustrating data from the flexural strength testing of a control specimen.

Graph FIG. 3 represents the data from the flexural strength testing of the control specimen I (detailed below) by measuring bending of the structure under increasing load until the structure fails to support the load and breaks. The vertical axis of the graph indicates the amount of load in pounds that was forced at the centerline of the tested surface of the structure. The horizontal axis indicates the downward displacement of the centerline, and therefore bending of the structure, as load was increased. Such displacement was measured relative to starting point at no load. Failure in terms of total break down is indicated by a drastic decrease in measured loading force in a further, very small displacement. In the graph of FIG. 3, the structure continued to support the load without any failure until the load reached an approximate value of 2500 pounds at which point the structure was severely cracked, and it ceased to support any further increase in the load. As indicated by the graph of FIG. 3, the structure was bent at an approximate value of about 0.257 inch under the load before failure occurred.

I—Control Specimen Composition:

A 24"×24"×4" wooden mold was made and lined with polypropylene sheet. Two #4 (½" diameter) rebar at each direction and 8" Off Center were laid at 2" depth of the mold, and a 2000 PSI concrete was mixed and placed in the mold to prepare the control concrete slab, and was left to cure for at least 28 days, forming the control specimen.

Results for II

Test Specimen

Figure 4:
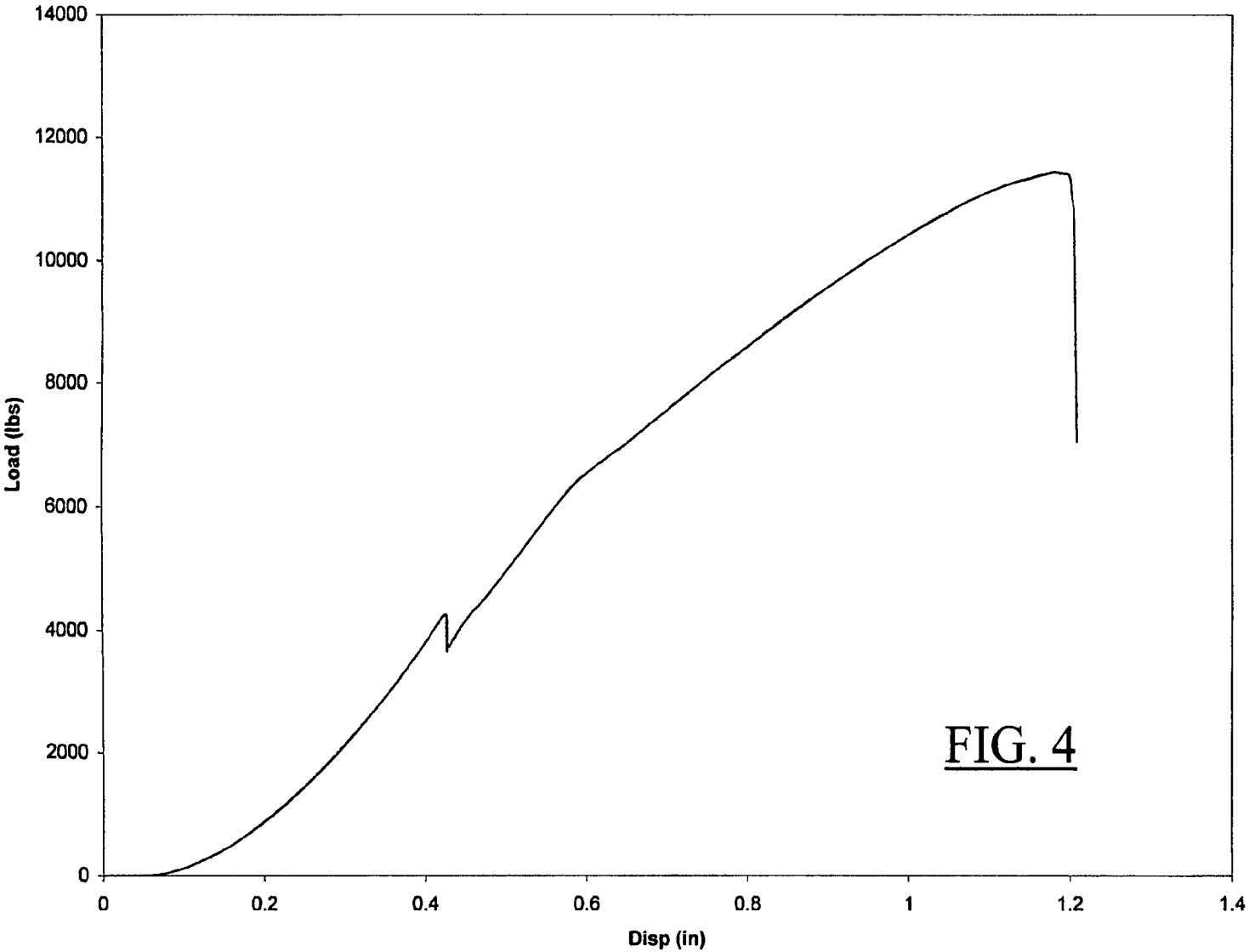
FIG. 4 is an exemplary graph, illustrating data from the flexural strength testing of a structure reinforced in accordance with the present invention.

Graph of FIG. 4 represents the data from the flexural strength testing of the reinforced structure in accordance with the present invention by measuring bending of the structure under increasing load until the structure fails to support the load and breaks. The vertical axis indicates the amount of load in pounds that was forced at the centerline of the tested surface of the structure. Such centerline was chosen to be perpendicular to the direction of the carbon fibers (also called the primary axis) of the fabric that was used in the reinforcement system. The horizontal axis indicates the downward displacement of the centerline, and therefore, bending of the structure, as load was increased. Such displacement was measured relative to starting point at no load. Failure in terms of total breakdown is indicated by a drastic decrease in measured loading force in a further, very small displacement. In the graph of FIG. 4, the structure continued to support the load without any failure until the load reached above 4225 pounds (significantly higher than the load applied to the unreinforced control specimen at failure), at which point the old part of the structure was cracked but the entire structure continued to support the increase in the load. A significant observation was that the old part of the structure was bent down to approximately 0.425 inch, significantly more than the unreinforced structure which implies that the reinforced structure can be bent further prior to any failure compared to the unreinforced control structure. As indicated by the graph of FIG. 4, total failure occurred at the load of approximately 11435 pounds, where structure was bent down to about 1.2 inches, which means that the reinforced structure was able to support significantly more load than the unreinforced control structure.

II—Test Specimen Composition:

1—A 24"×24"×4" wooden mold was made and lined with polypropylene sheet. Two #4 (½" diameter) rebar at each direction and 8" Off Center were laid at 2" depth of the mold, and a 2000 PSI concrete was mixed and placed in the mold to prepare the test concrete slab, and was left to cure for at least 28 days.

2—After molds were removed from the structure, the top surface of the structure was prepared by grinding off the laitance and removing dust.

3—The tensile layer was placed over the concrete (structure). The tensile layer was comprised of:

a. One layer, 32 wet mil thick, Primer.

The Primer was comprised of:

a two part 100% solids epoxy as described below, mixed at volume ratio of 2 to 1 for three minutes using a low speed jiffy mixer, and placed over the prepared surface of structure.

The following is the detailed description of the exemplary epoxy used:

Two-component Hi-Mod Epoxy

Type: Two-component high-modulus 100% solids epoxy.

Component A contains epoxy polymers and component B contains the hardener.

Mix ratio: 2 parts A to 1 part B by volume

Bond strength (2-day cure): 1200 PSI

Tensile strength (14-day cure): 6000 PSI

Elongation at break: 2-4%.

b—One layer of carbon fiber fabric, which was saturated with the above epoxy, placed over the primer layer while the polymer layer (primer) was still tacky (not fully cured). The epoxy-saturated carbon fiber fabric was placed over the primed surface of the structure in such a way that primary direction of the carbon fiber fabric, called primary axis, was coplanar with and perpendicular to the intended centerline of the structure along which the test load force was to be applied. The epoxy-saturated carbon fiber fabric was roll-pressed onto the tacky primed surface to ensure proper adhesion between the fabric and the primed surface of the structure.

The following is the detailed description of the exemplary carbon fiber fabric used:

Fiber type: Unidirectional Carbon Fiber Fabric

Type: High strength unidirectional carbon fiber fabric for structural strengthening Fabric weight (average): 600 grams/square meter Tensile strength (average): 700 KSI Tensile Modulus (average): 34 MSI c—700 KSI Carbon fiber anchors installed as follows (while the surface of the applied fabric was still tacky):

c—1. Four holes, each ⅜ of an inch in diameter and 2 inches deep were made in the top surface of the structure through the layers of carbon fiber fabric and polymer already applied to such surface. The location of each hole was approximately 7 inches away from each of the two adjacent sides of the top surface.

c—2. Each hole was filed with the above described epoxy.

c—3. Each bundle of anchoring carbon fiber was loosely folded at center and twisted loosely at the bottom half with bottom being the folded point.

c—4. One folded and twisted anchor bundle was placed in each hole with the folded end of the bundle put in first and pushed in towards the bottom of the hole.

c—5. The portion of each anchoring fiber bundle that remained outside the hole was flared and spread evenly and pressed onto the still tack surface of the fabric in a radial fashion.

d—One final layer, 32 mil epoxy as described above was placed over the still tacky layer comprising of the epoxy primer, saturated carbon fabric and spread fibers of the anchors.

3—A ¾" deep mold was attached to the top edges of the tensile layer and secured in place using a latex calking compound (not part of the reinforcement system) to create the mold for placing the compressive composite layer.

4—Before the last layer of polymer of the tensile layer was cured and while still tacky, a ¾" thick layer of compressive composite was prepared as follows and placed over the tensile layer and vibrated to release any air entrapment. The compressive composite was prepared as follows:

a—The liquid component of (Component A) of a two component polymer modified cementicious grout was poured into mixing container.

b—While mixing the component A, the powder component (Component B) of a two part component polymer modified cementitious grout was poured into the container and mixed per specifications.

c—Chopped glass fiber was added to the mix at the rate of 16 ounces per cubic feet during the final mixing.

5—The compressive composite layer was cured more than 28 days.

The following is the detailed description of the exemplary compressive composite layer used:

Two Component Polymer Modified Cementicious Grout

Mix Ratio Plant-proportioned kit, mix entire unit.

Flexural Strength (28-day cure): 1,500 PSI

Splitting Tensile Strength (28-day cure): 700 PSI

Bond Strength (28-day cure): 2,500 PSI

Compressive Strength (28-day cure): 7,000 PSI

Although the invention has been described in considerable detail in language very specific to structural features and or method acts, it is to be understood that the invention described is not necessarily limited to the specific features or acts described. Rather, the specific features and acts are disclosed as preferred, exemplary forms of implementing the claimed invention. Stated otherwise, it is to be understood that the phraseology and terminology employed herein are for the purpose of description and should not be regarded as limiting. Therefore, while exemplary illustrative embodiments of the invention have been described, numerous variations and alternative embodiments will occur to those skilled in the art. For example, different types of polymers 204 may be used depending on engineering and design specifications. The number of layers, types, and physical characteristics of fiber reinforced polymer composite laminate 206 may vary according to engineering and design criteria. Non-limiting, non-exhaustive exemplary list of physical characteristics for fiber reinforced polymer composite laminate 206 that may vary may include, fiber type, matrix resin (saturation polymer), area covered by fiber reinforced polymer composite laminate 206, density of fiber, weave, weight, orientation of fiber, type and specification of matrix resin, ratios of mix, manufacturer, testing method, etc. As another example, the depth and number of anchors, and spacing between them are subject to engineering and design requirements. Non-limiting, non-exhaustive exemplary list of physical characteristics for anchors that may vary may include number and or shape of studs or anchors, spacing between them, depth of dowel, impregnation resin, manufacturer, testing method, etc. As yet another example, the overlay 208 may be varied in accordance with engineering and designed to meet all specifications. Non-limiting, non-exhaustive exemplary list of physical characteristics for the overlay 208 that may vary may include the required compressive strength, required tensile strength, modulus of elasticity, use of metal or fiber in the mix, thickness of the overlay, method of application of overlay or finish, modification system (epoxy, urethane, acrylic, latex, etc.), testing method, etc. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, parallel, perpendicular, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A method for enhancement of structural integrity, comprising:

providing a reinforcement system to contribute mechanical strength to a structure to increase load bearing capacity of the structure;

adhesively integrally bonding the reinforcement system that includes adhesively integrally bonded layers with continuity over an entire surface of the structure subject to load with a compression side of the structure with a polymer matrix, with the bonding of the reinforcement system comprising operational act of:

integrally bonding an integrally bonded, continuous tension layer comprised of fiber reinforced polymer (FRP) composite with a high tensile strength that is significantly higher than tensile strength of the structure to counteract tensile stress in the structure in areas with negative bending moment;

adhesively integrally bonding the tension layer directly with the compression side of the structure with the polymer matrix; and integrally bonding a compression layer over an exposed, top surface of the integrally bonded, continuous tension layer with polymer matrix;

the compression layer having a high compression strength that is significantly higher than a compression strength of the structure to increase a bending resistance of the structure, with the tension layer having high tensile strength that is significantly higher than tensile strength of the compression layer to counteract tensile stress in the compression layer in areas with positive bending moments.

2. The method for enhancement of structural integrity as set forth in claim 1, wherein:

the bonding of the tension layer includes the operational act of:

reaching and preparing a surface of a substrate of the structure;

applying and bonding a first layer of polymer matrix onto the substrate to prime the substrate;

integrally bonding one or more layers of FRP composite with polymer matrix over the first layer, with the first layer capable of fully bonding to one or more layers of FRP composite;

inserting anchors through layers and into the substrate; and applying a final layer of the polymer matrix to the anchors to seal-off and encapsulate the anchors.

3. The method for enhancement of structural integrity as set forth in claim 2, wherein:

the bonding of the compression layer includes the operational act of:

applying an overlay onto the final layer, with the final layer capable of fully bonding to the overlay.

4. The method for enhancement of structural integrity as set forth in claim 3, wherein:

the bonding of the compression layer further includes the operational act of:

applying a sealer onto the overlay.

5. The method for enhancement of structural integrity as set forth in claim 2, wherein:

the operational act of preparation of the substrate is comprised of:

removing existing surface finishes, including any surface material not part of the substrate to expose a surface of the substrate;

reducing the substrate surface defects to obtain a proper substrate surface profile.

6. The method for enhancement of structural integrity as set forth in claim 5, wherein:

operational act of reducing the substrate surface defects includes:

patching substrate surface opening with material having physical characteristics at least equal to that of the substrate; and removing protuberances.

7. The method for enhancement of structural integrity as set forth in claim 2, wherein:

the polymer matrix is a fluid precursor that cures under ambient conditions to form the polymer.

8. The method for enhancement of structural integrity as set forth in claim 1, wherein:

the fiber reinforced polymer composite is comprised of one of a field saturated fiber reinforced polymer composite, pre-cured fiber reinforced polymer composite, and pre-impregnated fiber reinforced polymer composite.

9. The method for enhancement of structural integrity as set forth in claim 7, wherein:

the fiber reinforced polymer composite is comprised of a pre-cured fiber reinforced polymer composite.

10. The method for enhancement of structural integrity as set forth in claim 9, wherein:

fibers of the fiber reinforced polymer are saturated by polymer matrix.

11. The method for enhancement of structural integrity as set forth in claim 2, wherein:

one or more layers of fiber reinforced polymer composites are amassed layer-by-layer with a layer of the polymer matrix applied over each single layer of fiber reinforced polymer composite used.

12. The method for enhancement of structural integrity as set forth in claim 1, wherein:

fibers of material are saturated with polymer matrix to form the fiber reinforced polymer composites.

13. The method for enhancement of structural integrity as set forth in claim 2, wherein:

fibers of material are saturated with polymer matrix to form fiber reinforced polymer composite using the operational acts of:

saturating the fibers with polymer matrix to form the fiber reinforced polymer composite; and placing the fiber reinforced polymer composite onto the layer of polymer matrix.

14. The method for enhancement of structural integrity as set forth in claim 2, wherein:

fibers within the fiber reinforced polymer composite are comprised of strands that have high tensile strength and elongation properties.

15. The method for enhancement of structural integrity as set forth in claim 3, wherein:

the overlay is comprised of composite material with high compression strength.

16. The method for enhancement of structural integrity as set forth in claim 3, wherein:

the overlay is comprised of high compression composite material.

17. A system for enhancement of structural integrity, comprising:

a reinforcement system that contributes mechanical strength to a structure to increase load bearing capacity of the structure;

the reinforcement system includes one or more integrally bonded layers that are continuous over an entire surface of the structure subject to load and adhesively are bonded with a compression side of the structure with a polymer matrix, with the reinforcement system comprising:

an integrally bonded, continuous tension layer that is a fiber reinforced polymer (FRP) composite that has a high tensile strength that is significantly higher than tensile strength of the structure to counteract tensile stress in the structure in areas with negative bending moment;

the FRP composite is directly adhesively integrally bonded with the compression side of the structure with polymer matrix;

the exposed, top side of the tension layer is further integrally bonded with a continuous compression layer with the polymer matrix;

the compression layer has a high compression strength that is significantly higher than a compression strength of the structure to increase a bending resistance of the structure with the tension layer having high tensile strength that is significantly higher than tensile strength of the compression layer to counteract tensile stress in the compression layer in areas with positive bending moments.

18. The system for enhancement of structural integrity as set forth in claim 17, wherein:

the integrally bonded tension layer is comprised of:

a first layer of polymer matrix adhesively bonded over a prepared surface of a substrate of the structure;

one or more layers of FRP composite are integrally bonded over the first layer with polymer matrix; with the first layer capable of fully bonding to one or more layers of FRP composite;

anchors inserted through layers and into the substrate; and a final layer of the polymer matrix seals and encapsulates the anchors.

19. The system for enhancement of structural integrity as set forth in claim 17, wherein:

the compression layer is comprised of an overlay.

20. The system for enhancement of structural integrity as set forth in claim 17, wherein:

the compression layer further includes a sealer applied on top thereof.

21. The system for enhancement of structural integrity as set forth in claim 17, wherein:

the fiber reinforced polymer composite is comprised of one of a field saturated fiber reinforced polymer composite, pre-cured fiber reinforced polymer composite, and pre-impregnated fiber reinforced polymer composite.

22. The system for enhancement of structural integrity as set forth in claim 19, wherein:

the overlay is comprised of composite material with high compression strength.

23. A system for enhancement of structural integrity, comprising:

a reinforcement system that contributes mechanical strength to a structure to increase load bearing capacity of the structure;

the reinforcement system includes one or more adhesively integrally bonded layers that are continuous over an entire surface of the structure subject to load and are bonded with a compression side of the structure with a polymer matrix, with the reinforcement system comprising:

an integrally bonded, continuous tension layer that is a fiber reinforced polymer (FRP) composite that has a high tensile strength that is significantly higher than tensile strength of the structure to counteract tensile stress in the structure in areas with negative bending moment;

the tension layer is directly adhesively integrally bonded with the compression side of the structure with a polymer matrix;

the tension layer, including:

a first layer of polymer matrix integrally adhesively bonded over a surface of a substrate of the structure;

one or more layers of FRP composites are integrally adhesively bonded with the first layer, with the first layer capable of fully bonding to one or more integrally bonded layers of FRP composites;

anchors inserted through layers and into the substrate with a final layer of polymer matrix to seal-off and to fully encapsulate the anchors, and with an exposed, top side of the final layer of polymer matrix integrally adhesively bonded with a continuous compression layer, which is finally topped with a sealer;

the compression layer has a high compression strength that is significantly higher than a compression strength of the structure to increase a bending resistance of the structure, with the tension layer having high tensile strength that is significantly higher than tensile strength of the compression layer to counteract tensile stress in the compression layer in areas with positive bending moments.

24. A method for enhancement of structural integrity, comprising:

providing a reinforcement system that contributes mechanical strength to a structure to increase load bearing capacity of the structure;

adhesively bonding the reinforcement system that includes adhesively integrally bonded layers continuous over an entire surface of the structure subject to load with a compression side of the structure with a polymer matrix, with the bonding of the reinforcement system comprising operational act of:

integrally bonding an integrally bonded, continuous tension layer comprised of fiber reinforced polymer (FRP) composite with a high tensile strength that is significantly higher than tensile strength of the structure to counteract tensile stress in the structure in areas with negative bending moment;

adhesively integrally bonding the tension layer directly with the compression side of the structure with polymer matrix; and integrally adhesively bonding a compression layer over an exposed, top surface of the tension layer with polymer matrix;

the compression layer having a high compression strength that is significantly higher than a compression strength of the structure to increase a bending resistance of the structure, with the tension layer having high tensile strength that is significantly higher than tensile strength of the compression layer to counteract tensile stress in the compression layer in areas with positive bending moments;

the bonding of the tension layer includes the operational act of:

applying and bonding a first layer of polymer matrix over a prepared substrate to prime the substrate;

bonding the one or more layers of FRP composite over the first layer, with the first layer capable of fully bonding to the polymer matrix FRP composite;

inserting anchors through layers and into the substrate; and applying a final layer of the polymer matrix to the anchors to seal-off and encapsulate the anchors.

* * * * *